US007589682B1

(12) United States Patent
Wu et al.

(10) Patent No.: US 7,589,682 B1
(45) Date of Patent: Sep. 15, 2009

(54) SINGLE-PLATE DUAL-BAND ANTENNA AND WIRELESS NETWORK DEVICE HAVING THE SAME

(75) Inventors: Jung Tai Wu, Taipei (TW); Jin-Bo Chen, Taipei (TW)

(73) Assignee: Cameo Communications Inc. (TW)

( * ) Notice: Subject to any disclaimer, the term of this patent is extended or adjusted under 35 U.S.C. 154(b) by 1 day.

(21) Appl. No.: 12/077,333

(22) Filed: Mar. 18, 2008

(51) Int. Cl.
*H01Q 1/24* (2006.01)
*H01Q 1/38* (2006.01)

(52) U.S. Cl. ..... 343/702; 343/700 MS

(58) Field of Classification Search ..... 343/702, 343/700 MS, 846, 895
See application file for complete search history.

(56) References Cited

U.S. PATENT DOCUMENTS 6,593,888 B2 * 7/2003 Fu ..... 343/700 MS
7,154,443 B2 * 12/2006 Inaba et al. ..... 343/702
2008/0165065 A1 * 7/2008 Hill et al. ..... 343/702

* cited by examiner

*Primary Examiner*—Hoang V Nguyen

(57) ABSTRACT

The present invention discloses a single-plate dual-band antenna for a wireless network device. The antenna comprises a base portion, a ground portion, a radiating portion and a signal portion. The base portion is combined with the wireless network device. The ground portion has an end connected with the base portion and extends upwards from the base portion to a certain height. The signal portion is generally perpendicular to the radiating portion, the ground portion and the base portion, respectively. The signal portion has an upper side and a lower end. The upper side is formed with a connecting edge connected with the radiating portion while the lower end is formed with a feed pin, so that the signal portion generally has a downwardly tapered, inverted triangular structure. The radiating portion further comprises a first radiating section and a second radiating section. The first radiating section extends a first length from an upper end of the ground portion along the connecting edge of the signal portion, while the second radiating section extends a second length sinuously from an end of the first radiating section distal from the ground portion.

20 Claims, 11 Drawing Sheets

SINGLE-PLATE DUAL-BAND ANTENNA AND WIRELESS NETWORK DEVICE HAVING THE SAME

BACKGROUND OF INVENTION

1. Field of the Invention

The present invention relates to a single-plate dual-band antenna, and more particularly, to an integrally formed, resilient, single-plate dual-band antenna for use with a wireless network device, and a wireless network device having such antenna.

2. Description of the Prior Art

FIG. 1 is a perspective view of a conventional wireless network device 10 of a wireless network card, for example. The wireless network device 10 usually includes a main body 11, an internal circuit device 12 located inside the main body 11, a connector portion 13 located at one end of the main body 11 for connecting an external mainframe (not shown), and an antenna signal receiving/transmitting portion 14 located at another end of the main body 11 opposing the connector portion 13. Generally, the antenna signal receiving/transmitting portion 14 is provided with a housing that is made of a non-metal material. When the wireless network device 10 is connected to the external mainframe, the antenna signal receiving/transmitting portion 14 must be exposed outside of the external mainframe so as to effectively receive and transmit wireless signals.

FIG. 2 is a schematic view of a conventional internal circuit device 20 of wireless network device. The conventional internal circuit device 20 of the wireless network device includes a substrate 21, a control circuit 22 located on the substrate 21, a ground portion 23 covering a predetermined area of the substrate 21, and an antenna unit 24 electrically connected to the control circuit 22. The conventional antenna unit 24, as illustrated in FIG. 2, includes a first antenna 241 and a second antenna 242 located at two lateral sides of the substrate 21, respectively. Since the antenna unit of this conventional internal circuit device 20 is designed as printed monopole antenna printed on the substrate 21. Due to limitation in height difference along a vertical direction, this type of printed antenna can achieve a better radiation pattern and higher gain on an X-Y plane (horizontal plane) only by designing different shapes of the first antenna 241 and the second antenna 242; but there is almost no further improvement of antenna gain along the vertical Z direction. However, the design of current wireless network device tends to be a vertical stand type, so as to reduce the space occupied by the wireless network device, as well as to make the appearance of the wireless network device more modern and high-tech. It is obvious that the conventional printed antenna cannot meet the requirement for the vertical stand type wireless network device due to the poor gain along the vertical Z direction.

FIG. 3 is a chart showing a radiation pattern measured on an X-Y plane of the first antenna of the conventional printed antenna unit 24 as shown in FIG. 2. From the radiation pattern of FIG. 3, it can be seen that the peak gain value of the first antenna 241 along the vertical direction is only −15.89 dBi, which is apparently lower than the minimum standard acceptable by consumers (a general requirement is that the gain value should be at least higher than −10 dBi). Thus, there are still rooms for improvement regarding to the design of antenna, which is also critically important for meeting consumer's need for high performance antenna.

SUMMARY OF INVENTION

A first objective of the present invention is to provide a single-plate dual-band antenna having a three-dimensional single-plate antenna structure, which can be integrally formed by stamping, so that the antenna can be easily manufactured at a lower cost.

A second objective of the present invention is to provide an antenna for a wireless network device, wherein the antenna can be rapidly assembled with the wireless network device by being embedded therein and has an improved antenna radiation pattern for increasing a vertical gain of the antenna, eliminating dead spots and broadening an operating bandwidth of the antenna.

In order to achieve the aforementioned objectives, the present invention discloses a single-plate dual-band antenna which comprises a base portion, a ground portion, a radiating portion and a signal portion. The base portion is combined with a wireless network device. The ground portion has an end connected with the base portion and extends upwards from the base portion to a certain height. The signal portion is generally perpendicular to the radiating portion, the ground portion and the base portion, respectively. The signal portion has an upper side and a lower end, wherein the upper side is formed with a connecting edge connected with the radiating portion while the lower end is formed with a feed pin, so that the signal portion generally has a downwardly tapered, inverted triangular structure. The radiating portion further comprises a first radiating section and a second radiating section, wherein the first radiating section extends a first length from an upper end of the ground portion along the connecting edge of the signal portion while the second radiating section extends a second length sinuously from an end of the first radiating section distal from the ground portion. The different extension lengths of the first and second radiating sections provide two frequency bands for wireless communication, such as a band from 4.9 to 5.85 GHz and another band from 2.4 to 2.5 GHz. On the other hand, the inverted triangular structure of the signal portion broadens an operating bandwidth of the antenna. The antenna is a one-piece element integrally formed by stamping a thin, electrically conductive metal plate, which allows easy and rapid manufacture. In addition, the antenna can be conveniently assembled onto a substrate of a wireless network device and serves to increase a gain in a vertical direction as well as a bandwidth of the wireless network device.

In a preferred embodiment, the second radiating section stemming from the end of the first radiating section distal from the ground portion extends initially a distance in a same plane as the first radiating section and perpendicular to the connecting edge, and then extends another distance sinuously towards the ground portion in a shape resembling a continuous square wave, in which a total distance extended by the second radiating section is the second length, and the sinuous extension of the second radiating section is spaced from the first radiating section by a predetermined spacing.

In a preferred embodiment, the predetermined height is between 7 mm and 10 mm and the first length is between 15 mm and 17 mm while the second length is between 25 mm and 35 mm and the predetermined spacing is between 0.4 mm and 0.7 mm.

When the antenna of the present invention is utilized in a wireless network device, the wireless network device generally includes a substrate, a control circuit and at least one feed line. The substrate may be made of a dielectric material and may have at least one aperture defined thereon. The control circuit is formed on the substrate and may provide a wireless network transmitting function. The feed line is coupled to the control circuit. When the antenna assembles onto the wireless network device, a ground pin of a base portion of the antenna is inserted into the aperture, and the base portion is closely contact with a ground zone of the substrate. A feed pin of a signal portion of the antenna is coupled to the feed line. The wireless network device can thus be provided with an improved radiation pattern and a higher gain in the vertical direction as well as a significantly increased the antenna performance.

BRIEF DESCRIPTION OF THE DRAWINGS

The invention as well as a preferred mode of use, further objectives and advantages thereof will best be understood by reference to the following detailed description of an illustrative embodiment when read in conjunction with the accompanying drawings, wherein.

DETAILED DESCRIPTION

Figure 1:
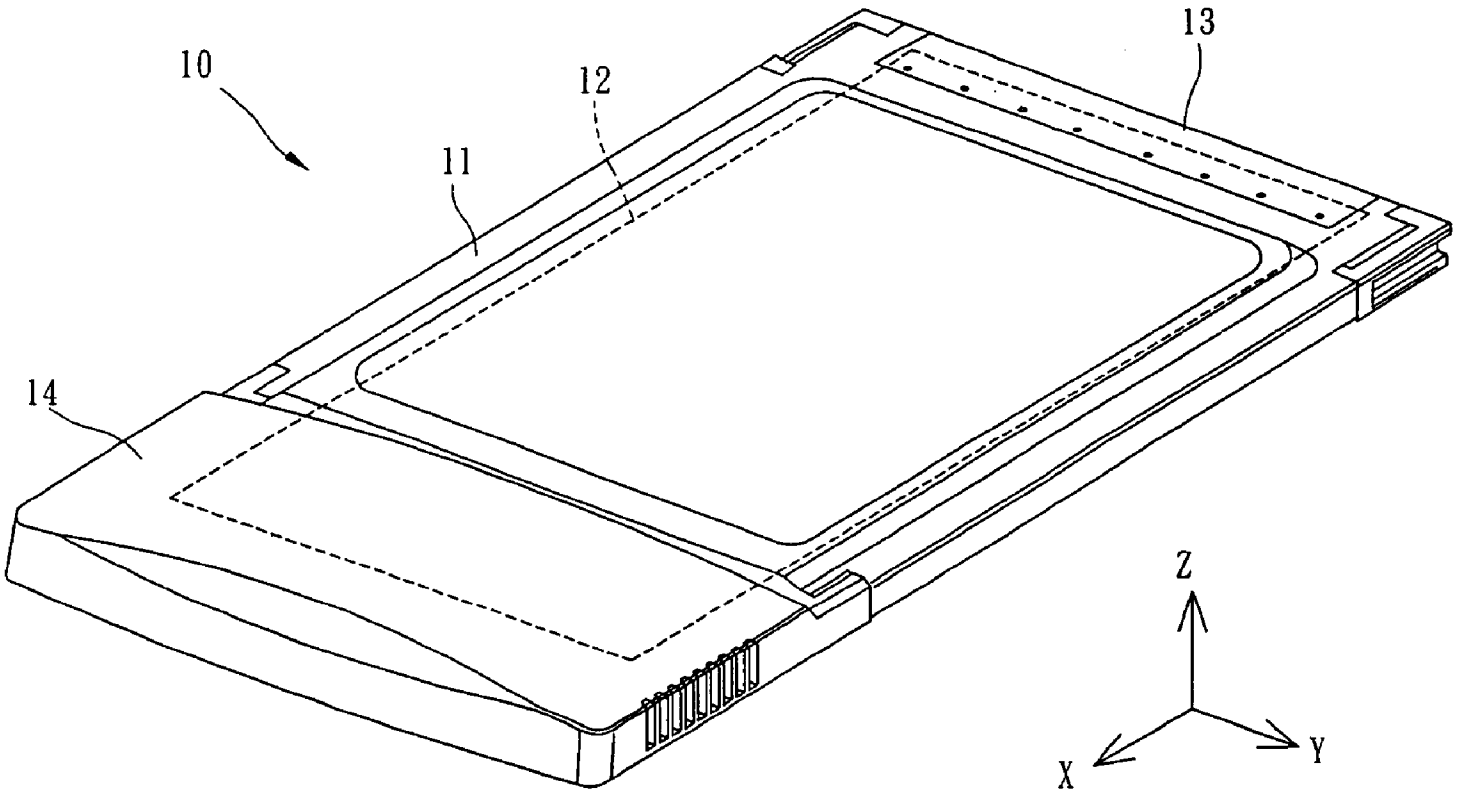
FIG. 1 (PRIOR ART)
FIG. 1 is a perspective view of a typical wireless network device.
Figure 2:
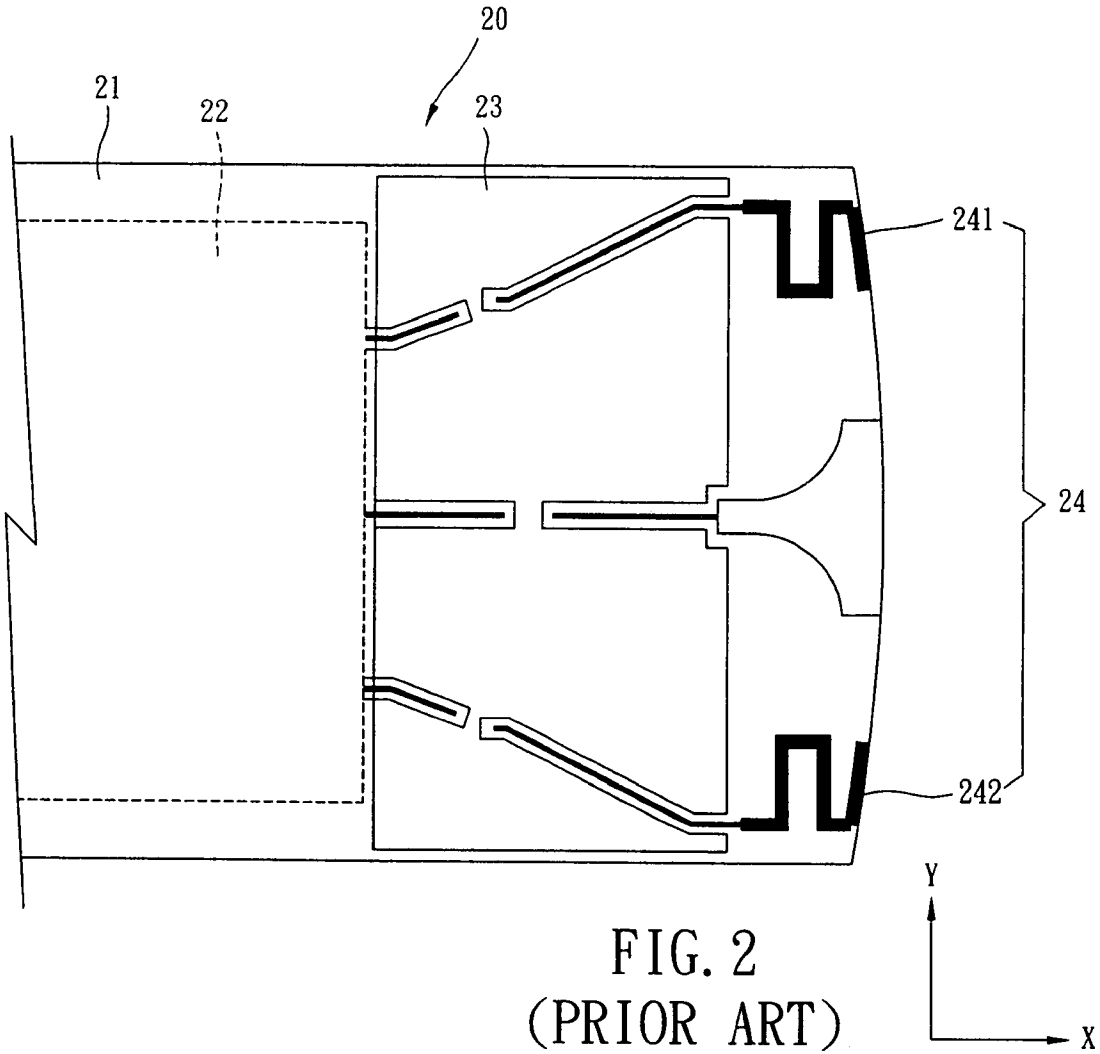
FIG. 2 (PRIOR ART)
FIG. 2 is a schematic view of a conventional internal circuit device of the wireless network device.

A single-plate dual-band antenna according to the present invention and a wireless network device having the same are based on the principle that a three-dimensional antenna structure integrally formed by stamping allows the antenna to be rapidly assembled onto a substrate of the wireless network device. Therein, a height difference between a radiating portion and a base portion of the single-plate dual-band antenna according to the present invention effectively increases a gain in a vertical direction, while a unique, downwardly tapered structure of a signal portion broadens an operating bandwidth. In addition, the radiating portion comprises a first radiating section and a second radiating section whose lengths are different. These two radiating sections provide two different frequency bands for wireless communication, such as a band from 4.9 to 5.85 GHz and another band from 2.4 to 2.5 GHz. Furthermore, the first and second radiating sections are spaced by a predetermined spacing which can be adjusted to modify an applicable frequency band of the antenna and increase a gain in a horizontal direction. Therefore, not only a greater gain in the vertical direction and a broader operating bandwidth can be obtained, but also the antenna can be manufactured and assembled with some other devices more conveniently and cost-effectively.

FIGS. 4 and 5A to 5C are a perspective structural drawing and schematic views from three different viewing angles of a single-plate dual-band antenna 5 according to a preferred embodiment of the present invention, respectively. The single-plate dual-band antenna 5 is a three-dimensional resilient single-plate element integrally formed by stamping and bending a thin, electrically conductive metal plate of, for example, copper, iron, aluminum, tin, nickel, silver, chromium, gold or an alloy of the above-mentioned metals. As a result, the antenna has a uniform thickness generally throughout the entire structure except where it is bent. In this embodiment, the antenna 5 is a planar inverted-F antenna (PIFA) comprising a base portion 51, a ground portion 52, a radiating portion 53 and a signal portion 54.

Figure 4:
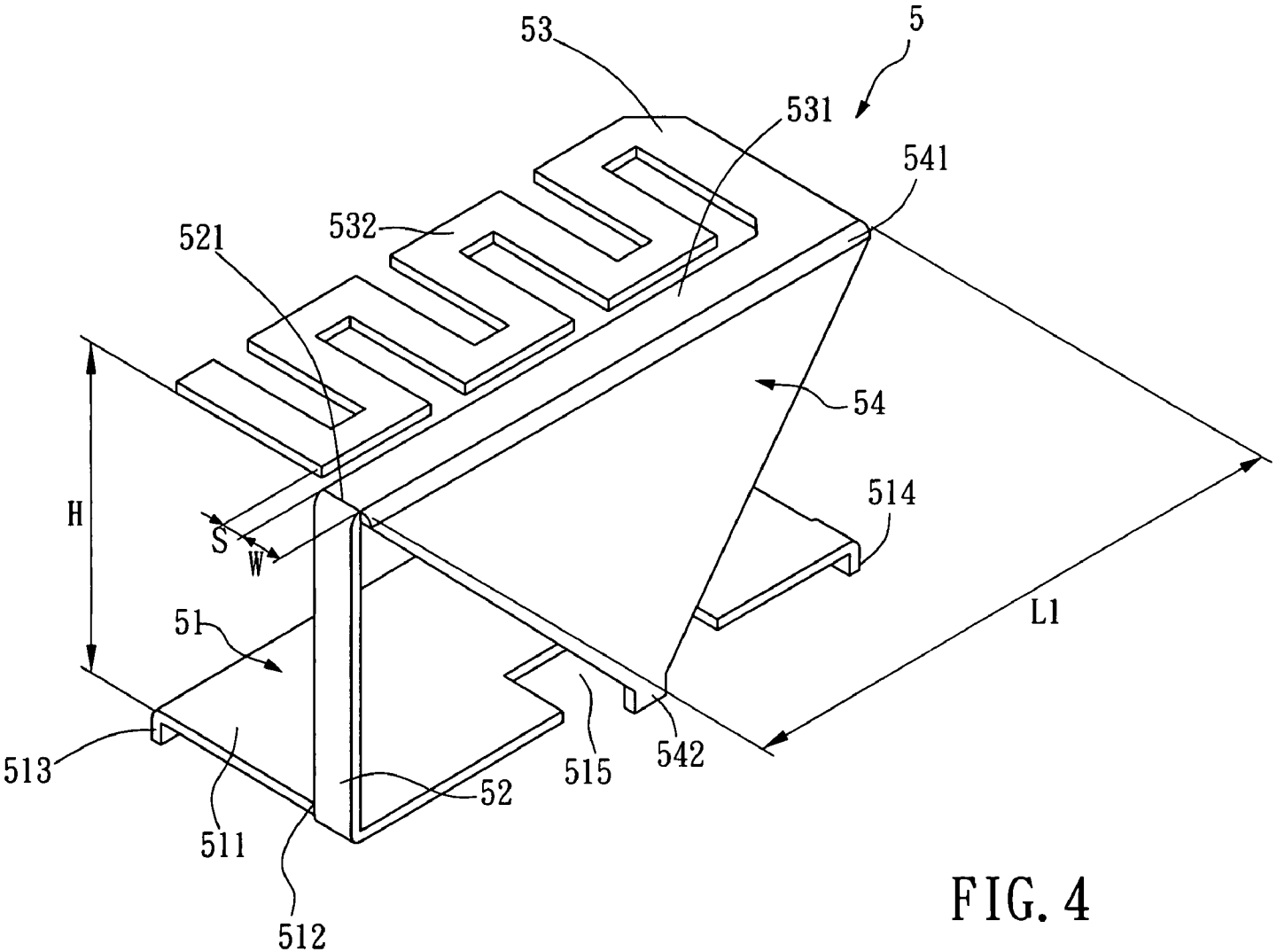
FIG. 4 is a perspective structural drawing of a single-plate dual-band antenna according to a preferred embodiment of the present invention.
Figure 5A:
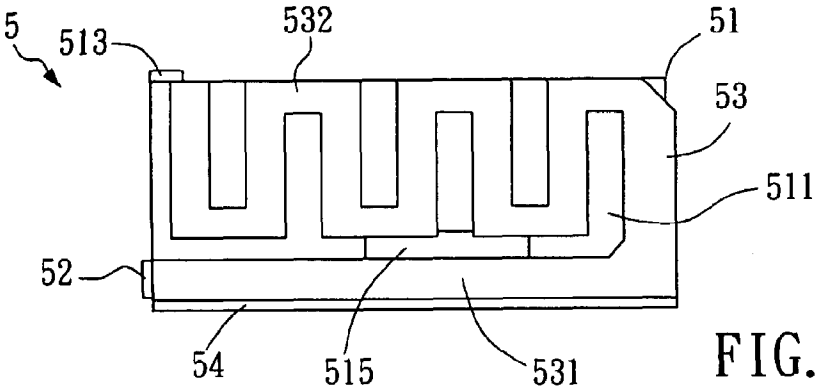
FIG. 5A is a top view of the antenna in FIG. 4.
Figure 5B:
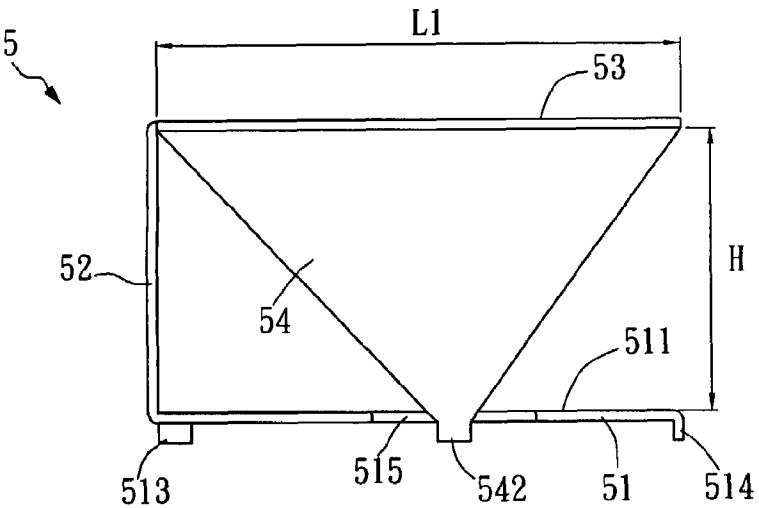
FIG. 5B is a right view of the antenna in FIG. 4.
Figure 5C:
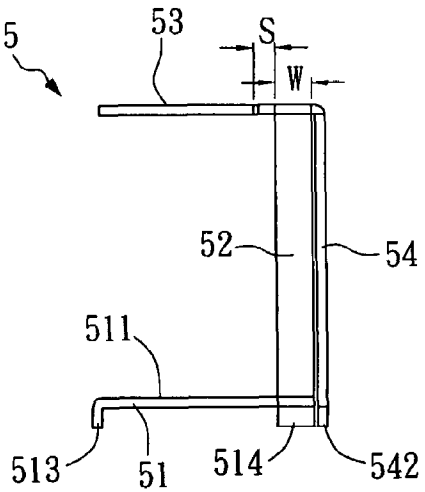
FIG. 5C is a front view of the antenna in FIG. 4.
Figure 6:
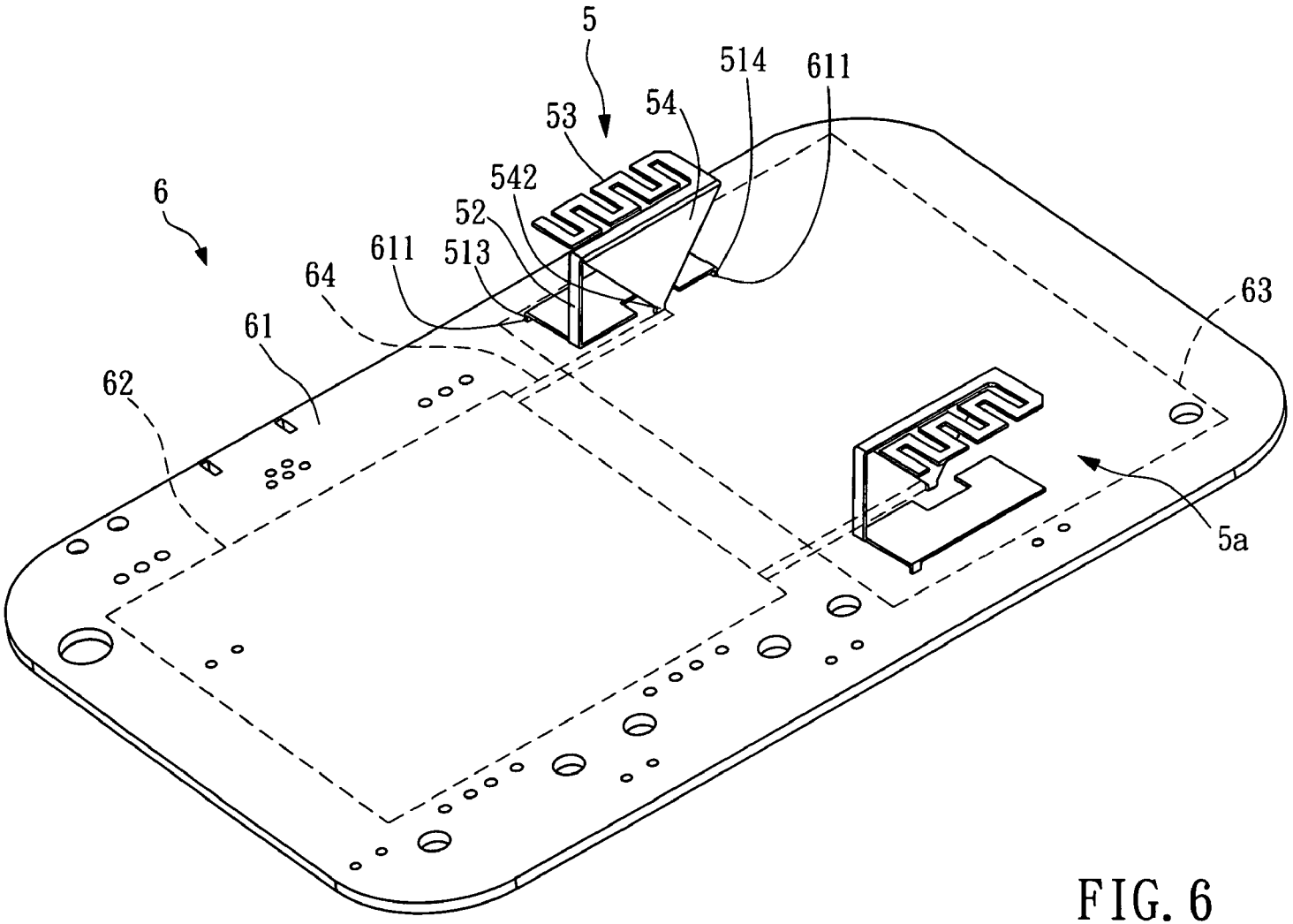
FIG. 6 is a schematic structural drawing of a preferred embodiment of a wireless network device having the antenna according to the present invention.
Figure 7A:
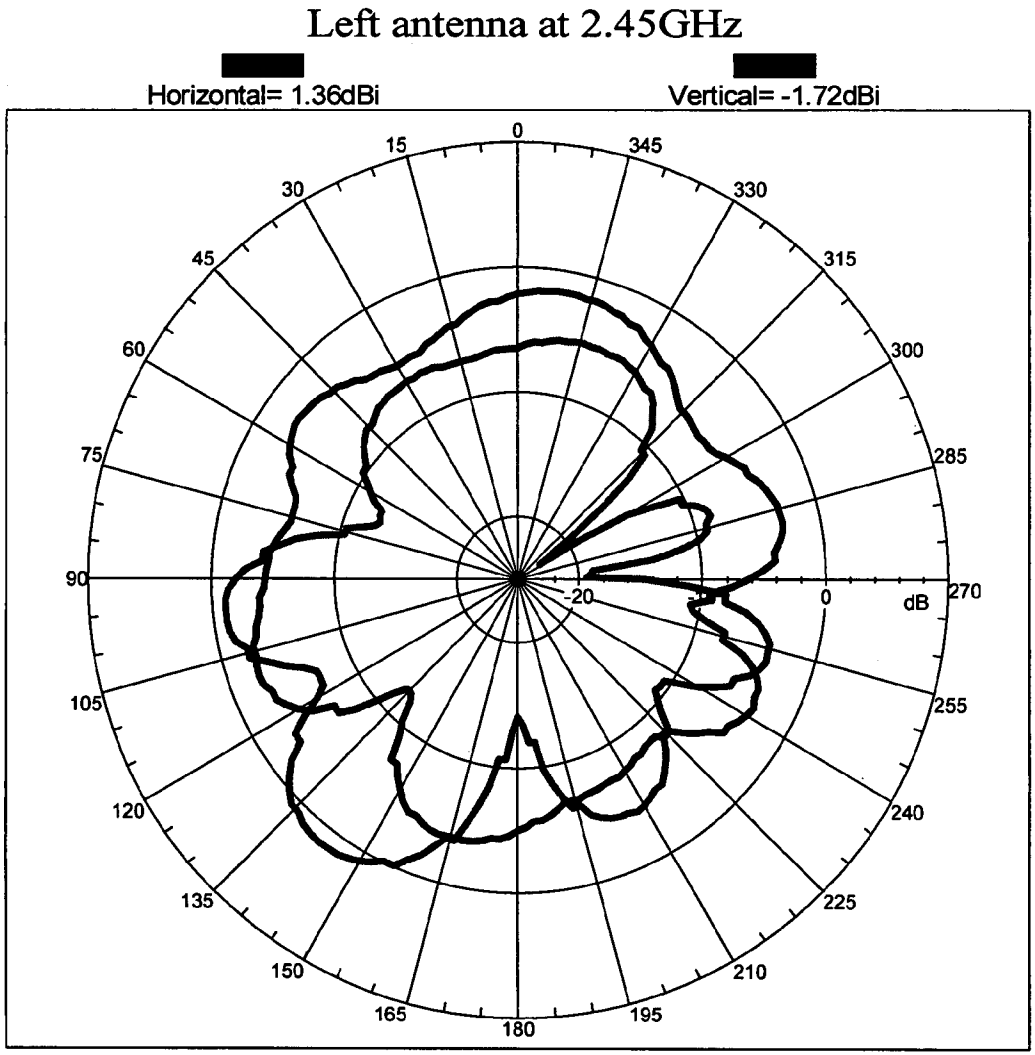
FIG. 7A illustrates a radiation pattern in an X-Y plane at an applicable frequency band of 2.45 GHz for a left antenna in FIG. 6.
Figure 7B:
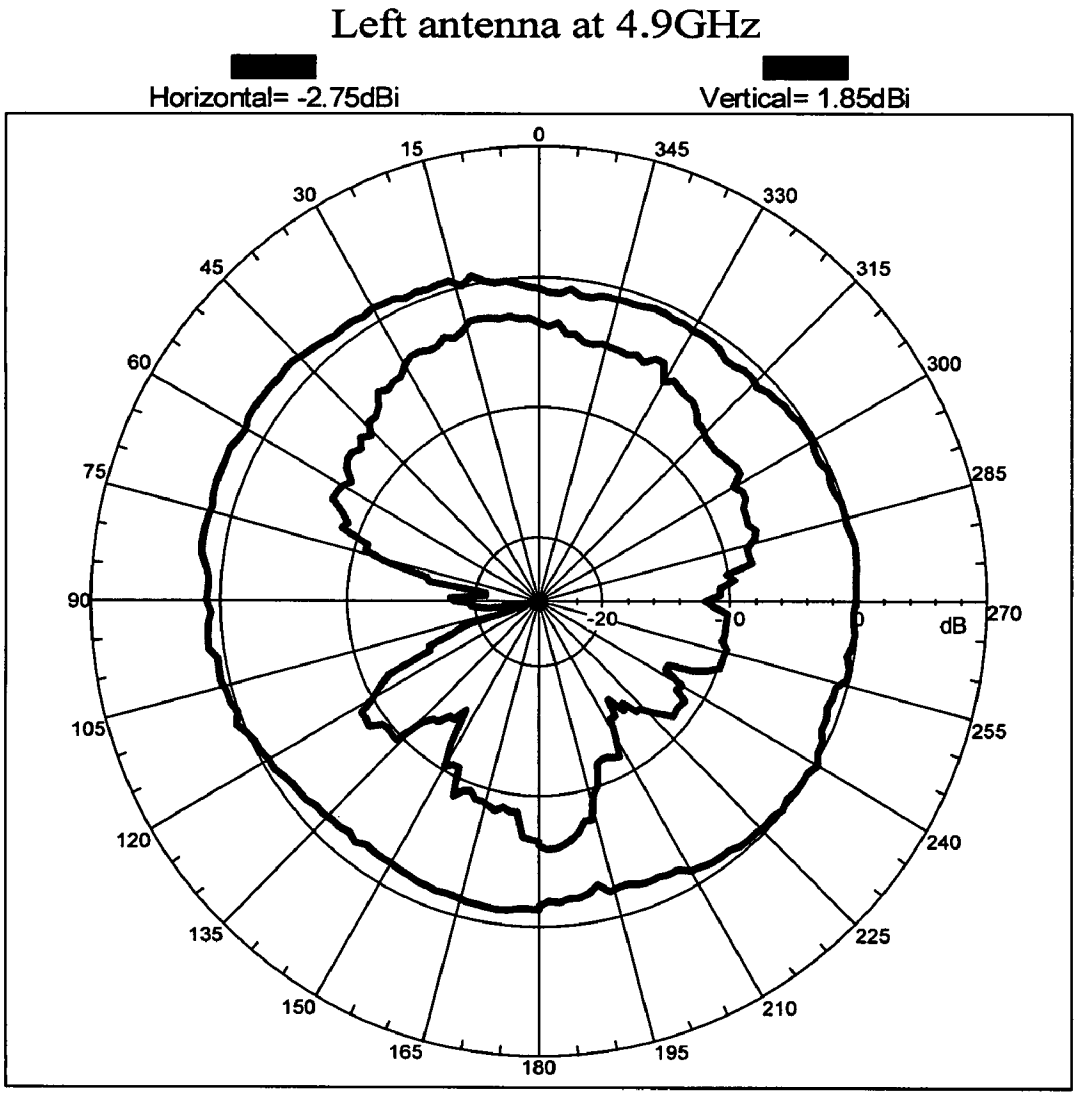
FIG. 7B illustrates a radiation pattern in the X-Y plane at an applicable frequency band of 4.9 GHz for the left antenna in FIG. 6.
Figure 7C:
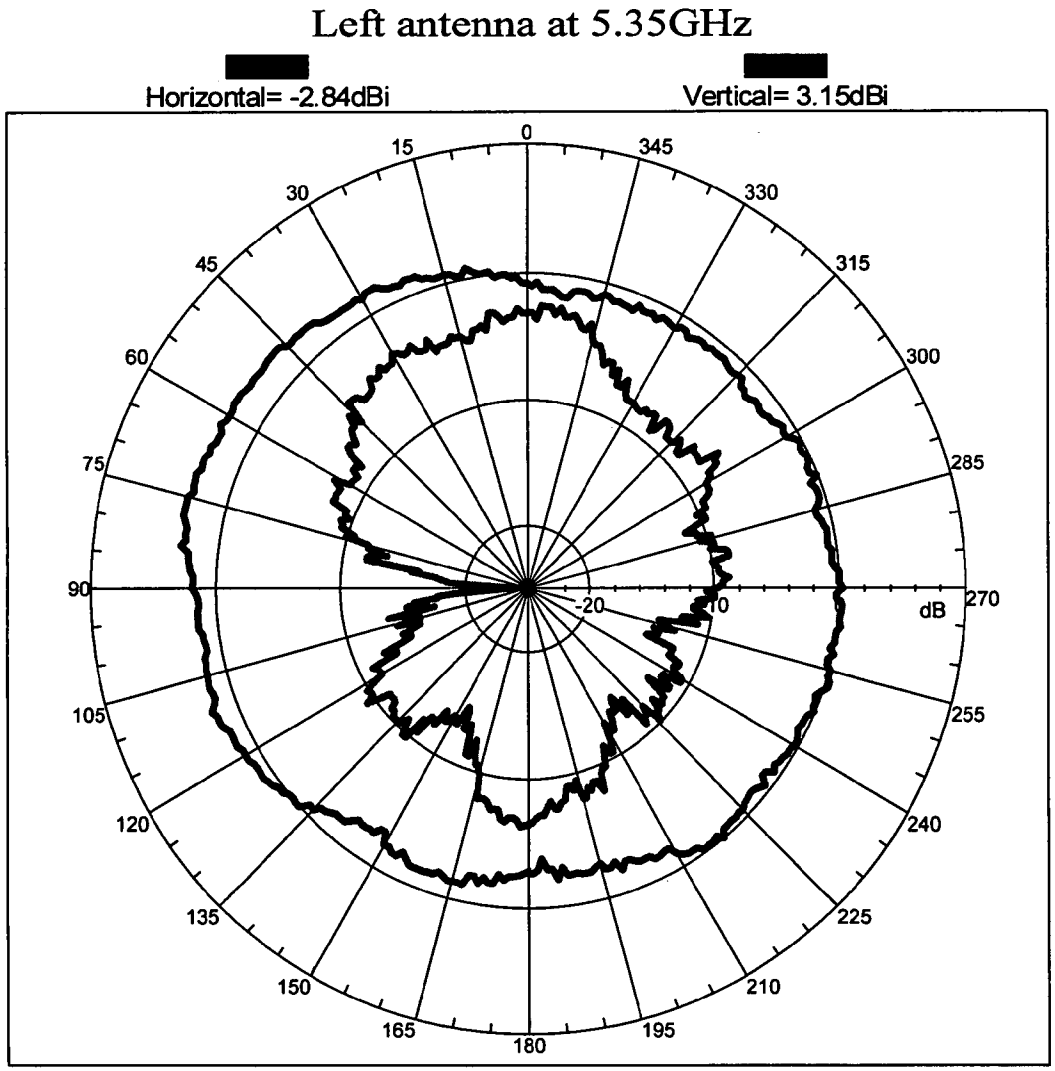
FIG. 7C illustrates a radiation pattern in the X-Y plane at an applicable frequency band of 5.35 GHz for the left antenna in FIG. 6.
Figure 7D:
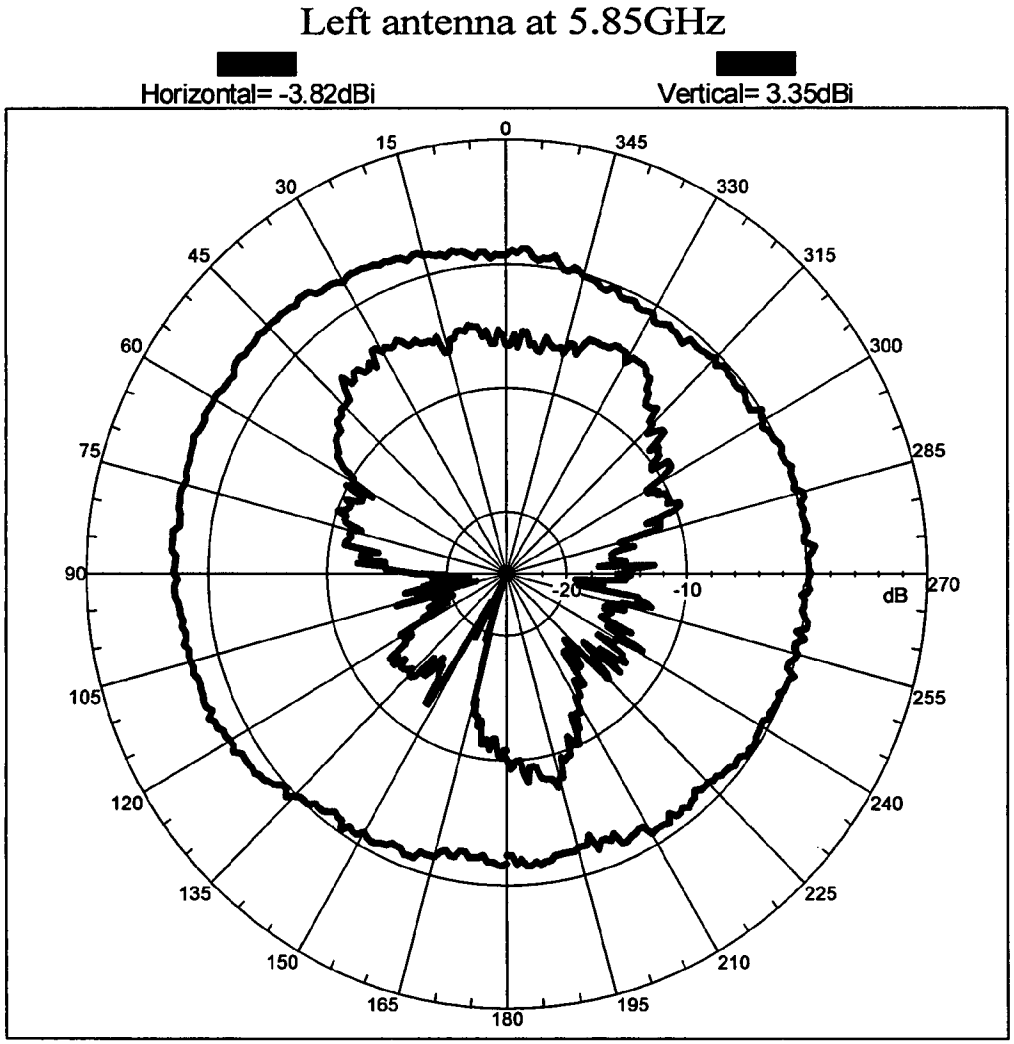
FIG. 7D illustrates a radiation pattern in the X-Y plane at an applicable frequency band of 5.85 GHz for the left antenna in FIG. 6.

The base portion 51 has an upper surface 511 in a generally rectangular shape and a connecting edge 512 adjacent to where the base portion 51 is connected with the ground portion 52. The base portion 51 further has a connecting pin 513 formed at the connecting edge 512 and a ground pin 514 formed at a side of the base portion 51 distal from the ground portion 52 for electrical connection with an external ground, such as a ground zone 63 on a substrate 61 of a wireless network device 6, as shown in FIG. 6. According to the present invention, the connecting pin 513 can be a downward protrusion from an end of the connecting edge 512 as shown in FIG. 4, or a soldering point located near the ground portion 52 (without protruding downwards). Furthermore, the base portion 51 has a cut 515 whose location on the base portion 51 corresponds to a feed pin 542 formed at a lower end of the signal portion 54, so that the feed pin 542 can extend below the base portion 51 without contacting the base portion 51.

The ground portion 52 has an end connected with the upper surface 511 of the base portion 51 and extends generally vertically upwards from the base portion 51 to a predetermined height H, wherein 7 mm<H<10 mm. The value of the predetermined height H can be controlled and adjusted to increase a gain of the single-plate dual-band antenna 5 according to the present invention in a vertical direction and reduce dead spots.

The radiating portion 53 has a lateral end connected with an upper end 521 of the ground portion 52 distal from the base portion 51. Furthermore, the radiating portion 53 extends a predetermined length generally horizontally from the upper end 521 of the ground portion 52 to form a predetermined shape. As a result, the radiating portion 53 is generally perpendicular to the ground portion 52 and generally parallel to the upper surface 511 of the base portion 51. Moreover, the radiating portion 53 has a vertically projected area generally encompassed by the upper surface 511 of the base portion 51.

In this embodiment of the present invention, the radiating portion 53 further comprises a first radiating section 531 and a second radiating section 532. The first radiating section 531 extends a first length L1 from the upper end 521 of the ground portion 52 along the connecting edge 541 connecting the signal portion 54 and the radiating portion 53 while the second radiating section 532 extends a second length L2 (not designated in the figures) sinuously from an end of the first radiating section 531 distal from the ground portion 52. In this embodiment, the second radiating section 532 stemming from the end of the first radiating section 531 distal from the ground portion 52 extends initially a distance in a same plane as the first radiating section 531 and perpendicular to the connecting edge 541 of the signal portion 54, and then extends another distance sinuously towards the ground portion 52 in a shape resembling a continuous square wave, wherein a total distance extended by the second radiating section 532 is the second length L2 (not designated in the figures). In addition, the sinuous extension of the second radiating section 532 is spaced from the first radiating section 531 by a predetermined spacing s. In this embodiment, 15 mm<L1<17 mm, 25 mm<L2<35 mm and 0.4 mm<s<0.7 mm. The first radiating section 531 allows the wireless network device 6 to conduct wireless communication in a first frequency band (such as from 4.9 to 5.85 GHz, and usually a frequency band for wireless communication in conformity with IEEE 802.11a or Ultra-Wideband (UWB) specifications) whereas the second radiating section 532 allows the wireless network device 6 to conduct wireless communication in a second frequency band (such as from 2.4 to 2.5 GHz, and usually a frequency band for wireless communication in conformity with IEEE 802.11b/g specifications). Therefore, the single-plate dual-band antenna 5 according to the present invention is applicable to two different frequency bands, i.e., 2.4~2.5 GHz and 4.9~5.85 GHz. Besides, the operating frequency band of the antenna 5 can be adjusted and a gain in the horizontal direction increased by adjusting the spacing s.

While the connecting edge 541 formed at an upper side of the signal portion 54 is connected with the first radiating section 531 of the radiating portion 53, the signal portion 54 itself extends a predetermined height downwards from the radiating portion 53 so that the feed pin 542 formed at the lower end of the signal portion 54 (i.e., an end of the signal portion 54 distal from the radiating portion 53) is slightly lower than the base portion 51. As a result, the signal portion 54 is generally perpendicular to the radiating portion 53, the ground portion 52 and the base portion 51, respectively. A width of the connecting edge 541 connecting the signal portion 54 with the radiating portion 53 is greater than a width of the end of the signal portion 54 distal from the radiating portion 53 (i.e., the feed pin 542) so that the signal portion 54 generally has an inverted triangular structure. This downwardly tapered structure of the signal portion 54 contributes to increasing an operating bandwidth of the single-plate dual-band antenna 5 according to the present invention.

FIG. 6 is a schematic drawing of a preferred embodiment of an internal circuit layout of the wireless network device 6 having the single-plate dual-band antenna according to the present invention. The wireless network device 6 according to the present invention comprises the substrate 61, a control circuit 62, a ground zone 63, at least one feed line 64 and at least one single-plate dual-band antenna 5, 5*a* of the present invention. The substrate 61 is made of a dielectric material and has a generally flat and rectangular shape. The substrate 61 is further provided with a plurality of apertures 611. The ground zone 63 provides electrical connection to a ground (GND) and generally covers an area where the single-plate dual-band antennas 5, 5*a* are installed. The control circuit 62 is disposed on the substrate 61 and comprises a circuit layout, a number of integrated circuit elements and a number of electronic elements. The control circuit 62 provides wireless transmission functions in conformity with 802.11a, 802.11b, 802.11g, 802.11n and/or UWB communication protocols. Since the control circuit 62 can be selected from prior art devices and does not constitute a major technical feature of the present invention, a detailed description of its structure is herein omitted.

As most components of the antennas 5 and 5*a* in this embodiment are the same as or similar to those of the foregoing embodiment, said same components are designated by same names and reference numerals. The two antennas 5 and 5*a* are mounted on two lateral sides of a front end of the substrate 61 in a mirroring manner. However, it is understood that there can be only one or more than two antennas 5 mounted at predetermined locations on the substrate 61 as needed, and the antenna(s) may be arranged in a predetermined way other than described above. The number and arrangement of the antenna 5 are not major technical features of the present invention and therefore will not be explained further. In addition, the connecting pin 513, the ground pin 514 and the feed pin 542 are located on the antenna 5 in such a way that each of the pins 513, 514 and 542 has a corresponding aperture 611 on the substrate 61. Therefore, when the pins 513, 514 and 542 are connected with the corresponding apertures 611, respectively, a lower surface of the base portion 51 will be in contact with an upper surface of the substrate 61. As a result, the feed pin 542 is connected with the feed line 64, which in turn is connected with the control circuit 62, to enable signal transmission.

Figure 3:
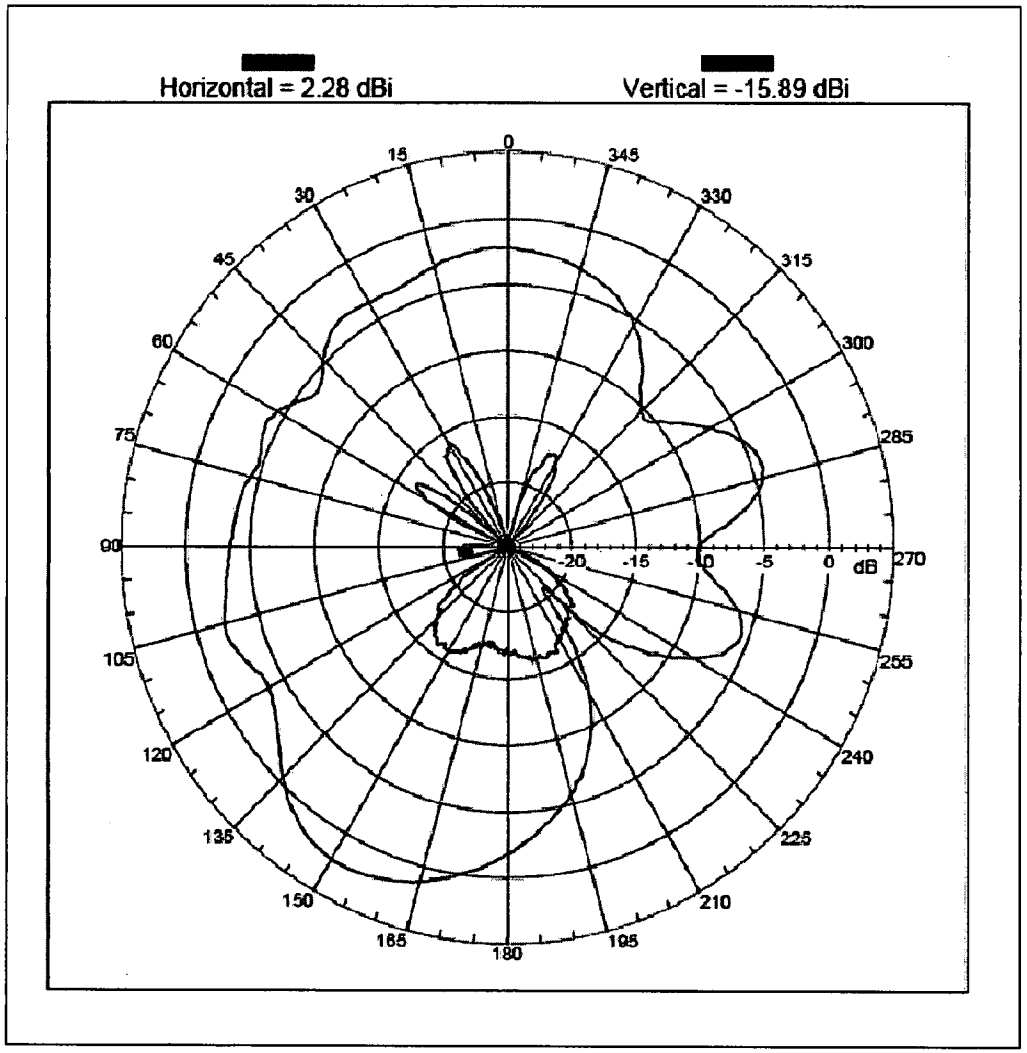
FIG. 3 (PRIOR ART)
FIG. 3 is a chart showing a radiation pattern measured on an X-Y plane of the first antenna of the conventional antenna unit as shown in FIG. 2.

FIGS. 7A to 7D illustrate radiation patterns in an X-Y plane at applicable frequency bands of 2.45, 4.9, 5.35 and 5.85 GHz, respectively, for the left antenna 5 in FIG. 6. It is shown in the radiation pattern in FIG. 7A that the left antenna 5 according to the present invention has a gain as high as −1.72 dBi in a vertical direction at the applicable frequency band of 2.45 GHz. At the applicable frequency band of 4.9 GHz, the antenna 5 has a gain in the vertical direction as high as 1.85 dBi as shown in the radiation pattern in FIG. 7B. At the applicable frequency band of 5.35 GHz, as shown in the radiation pattern in FIG. 7C, the antenna 5 has a vertical gain as high as 3.15 dBi. At the applicable frequency band of 5.85 GHz, the antenna 5 has a vertical gain as high as 3.35 dBi as shown in the radiation pattern in FIG. 7D. According to FIGS. 7A to 7D, the single-plate dual-band antenna 5 of the present invention has a vertical gain much higher than that of the conventional antenna in FIG. 3, i.e., −15.89 dBi. Furthermore, it can also be seen in FIGS. 7B to 7D that the vertical gain of the antenna 5 according to the present invention is presented in the radiation patterns as having a generally circular shape, meaning that radiation is emitted more evenly at different angles and in different directions with no dead spots, so that the quality of communication is improved.

Figure 8:
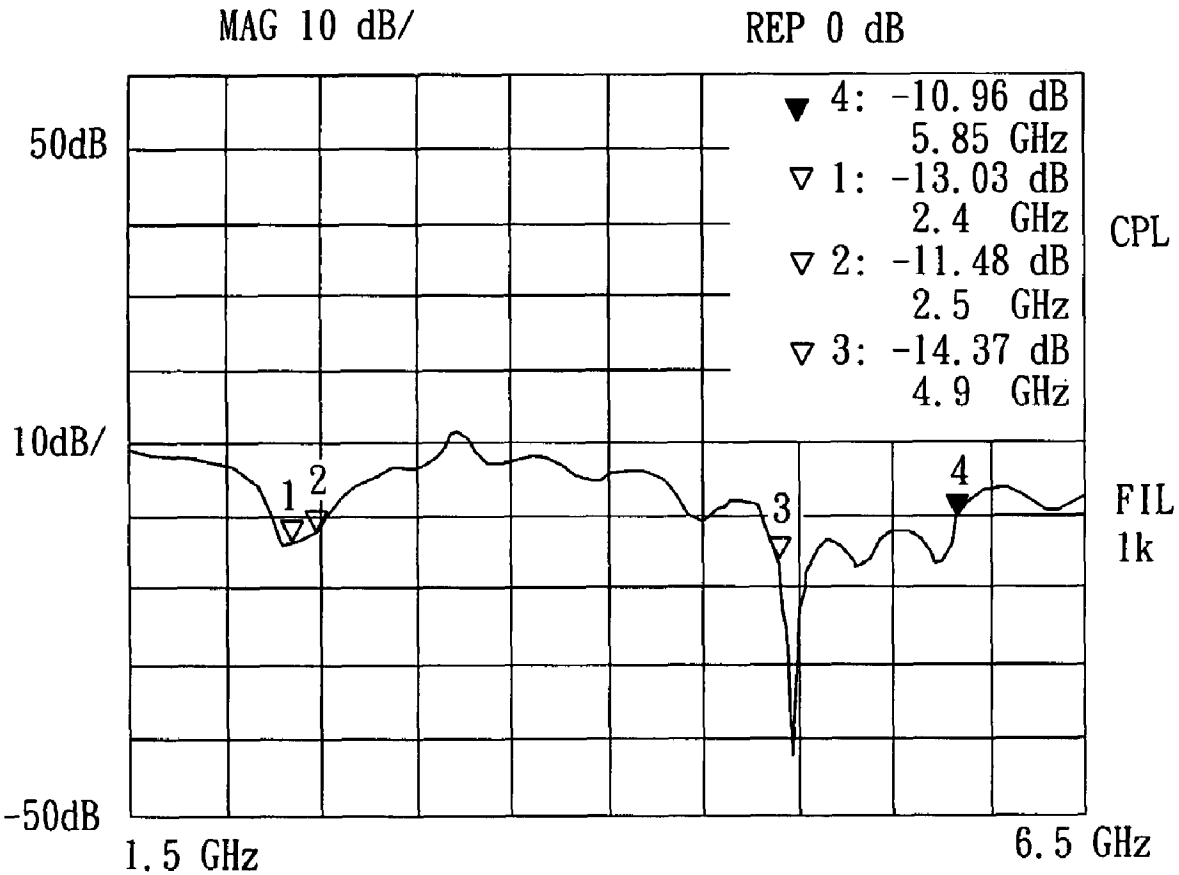
FIG. 8 is a plot showing return loss versus frequency for the single-plate dual-band antenna of the present invention shown in FIG. 6.

FIG. 8 is a plot showing test results of return loss of the antenna according to the present invention as shown in FIG. 6. It is shown in FIG. 8 that the antenna according to the present invention has a return loss generally between −11.48 and −13.03 dBi at a frequency band between 2.4 and 2.5 GHz, and a return loss of −14.37 dBi and −10.96 dBi at 4.9 GHz and 5.85 GHz, respectively. These values of return loss, which are all smaller than −10 dBi, already meet the market's demands of a high performance antenna design. Compared with conventional techniques, the antenna 5 according to the present invention not only provides a higher quality in wireless communication and better transmission efficiency in the vertical direction, but also offers a much wider operating bandwidth comprising two different frequency bands, i.e., 2.4~2.5 GHz and 4.9~5.85 GHz. Moreover, the antenna 5 according to the present invention has a resilient three-dimensional single-plate PIFA structure that can be integrally formed by stamping, which contributes to convenience in manufacture as well as a lower cost.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A single-plate dual-band antenna, comprising:

a base portion;

a ground portion, which has an end connected with the base portion and extends upwards from the base portion to a predetermined height;

a radiating portion, having an end connected with an upper end of the ground portion distal from the base portion, wherein the radiating portion is generally parallel to the base portion; and a signal portion, having a connecting edge connected with the radiating portion, wherein the signal portion is generally perpendicular to the radiating portion, the ground portion and the base portion, respectively, and the signal portion has a feed pin formed at a lower end thereof distal from the radiating portion;

wherein the radiating portion further comprises a first radiating section and a second radiating section, in which the first radiating section extends a first length from the upper end of the ground portion along the connecting edge of the signal portion while the second radiating section extends a second length sinuously from an end of the first radiating section distal from the ground portion.

2. The antenna as claimed in claim 1, wherein the single-plate dual-band antenna is a one-piece three-dimensional element integrally formed by stamping a thin, electrically conductive metal plate.

3. The antenna as claimed in claim 1, wherein the connecting edge connecting the signal portion with the radiating portion has a width greater than a width of the end of the signal portion distal from the radiating portion, so that the signal portion generally has a downwardly tapered, inverted triangular structure.

4. The antenna as claimed in claim 1, wherein the radiating portion has a vertically projected area generally encompassed by the base portion, and the base portion has a cut whose location on the base portion corresponds to the feed pin, so that the feed pin can extend below the base portion without contacting the base portion.

5. The antenna as claimed in claim 1, wherein a connecting pin is formed at least at a location adjacent to where the base portion is connected with the ground portion, for electrical connection with a ground zone of a wireless network device.

6. The antenna as claimed in claim 1, wherein the second radiating section stemming from the end of the first radiating section distal from the ground portion extends initially a distance in a same plane as the first radiating section and perpendicular to the connecting edge, and then extends another distance sinuously towards the ground portion in a shape resembling a continuous square wave, in which a total distance extended by the second radiating section is the second length, and the sinuous extension of the second radiating section is spaced from the first radiating section by a predetermined spacing.

7. The antenna as claimed in claim 6, wherein the predetermined height is between 7 mm and 10 mm and the first length is between 15 mm and 17 mm while the second length is between 25 mm and 35 mm and the predetermined spacing is between 0.4 mm and 0.7 mm.

8. A single-plate dual-band antenna for a wireless network device, comprising:

a base portion, for being combined with the wireless network device;

a ground portion, extending upwards from the base portion to a predetermined height;

a radiating portion, connected with an upper end of the ground portion distal from the base portion and being generally perpendicular to the ground portion, wherein the radiating portion further comprises a first radiating section and a second radiating section, in which the first radiating section allows the wireless network device to conduct wireless communication in a first frequency band while the second radiating section allows the wireless network device to conduct wireless communication in a second frequency band; and a signal portion, having a connecting edge connected with the radiating portion, wherein the signal portion is generally perpendicular to the radiating portion, the ground portion and the base portion, respectively, in which the signal portion has a feed pin formed at a lower end thereof distal from the radiating portion, and the connecting edge connecting the signal portion with the radiating portion has a width greater than a width of the end of the signal portion distal from the radiating portion, so that the signal portion generally has a downwardly tapered, inverted triangular structure.

9. The antenna as claimed in claim 8, wherein the single-plate dual-band antenna is a one-piece three-dimensional element integrally formed by stamping a thin, electrically conductive metal plate.

10. The antenna as claimed in claim 8, wherein the radiating portion has a vertically projected area generally encompassed by the base portion, and the base portion has a cut whose location on the base portion corresponds to the feed pin, so that the feed pin can extend below the base portion without contacting the base portion.

11. The antenna as claimed in claim 8, wherein a connecting pin is formed at least at a location adjacent to where the base portion is connected with the ground portion, for electrical connection with a ground zone of a wireless network device.

12. The antenna as claimed in claim 8, wherein the first radiating section extends a first length from the upper end of the ground portion along the connecting edge of the signal portion, while the second radiating section extends a second length sinuously from an end of the first radiating section distal from the ground portion.

13. The antenna as claimed in claim 12, wherein the second radiating section stemming from the end of the first radiating section distal from the ground portion extends initially a distance in a same plane as the first radiating section and perpendicular to the connecting edge, and then extends another distance sinuously towards the ground portion in a shape resembling a continuous square wave, in which a total distance extended by the second radiating section is the second length, and the sinuous extension of the second radiating section is spaced from the first radiating section by a predetermined spacing.

14. The antenna as claimed in claim 13, wherein the predetermined height is between 7 mm and 10 mm and the first length is between 15 mm and 17 mm while the second length is between 25 mm and 35 mm and the predetermined spacing is between 0.4 mm and 0.7 mm.

15. A wireless network device comprising:

a substrate, made of a dielectric material and having a plurality of apertures, wherein the substrate is further provided with a ground zone for electrical connection to a ground;

a control circuit, disposed on the substrate for providing wireless communication functions;

at least one feed line, connected with the control circuit; and at least one single-plate dual-band antenna, disposed within the ground zone of the substrate, wherein the single-plate dual-band antenna comprises:

a base portion, for electrical connection with the ground zone;

a ground portion, which has an end connected with the base portion and extends upwards from the base portion to a predetermined height;

a radiating portion, having an end connected with an upper end of the ground portion distal from the base portion, wherein the radiating portion is generally parallel to the base portion; and a signal portion, having a connecting edge connected with the radiating portion, wherein the signal portion is generally perpendicular to the radiating portion, the ground portion and the base portion, respectively, and the signal portion has a feed pin formed at a lower end thereof distal from the radiating portion, wherein the feed pin is in connection with the feed line;

wherein the radiating portion further comprises a first radiating section and a second radiating section, in which the first radiating section extends a first length from the upper end of the ground portion along the connecting edge of the signal portion while the second radiating section extends a second length sinuously from an end of the first radiating section distal from the ground portion.

16. The wireless network device as claimed in claim 15, wherein the single-plate dual-band antenna is a one-piece three-dimensional element integrally formed by stamping a thin, electrically conductive metal plate.

17. The wireless network device as claimed in claim 15, wherein the connecting edge connecting the signal portion with the radiating portion has a width greater than a width of the end of the signal portion distal from the radiating portion, so that the signal portion generally has a downwardly tapered, inverted triangular structure.

18. The wireless network device as claimed in claim 15, wherein the radiating portion has a vertically projected area generally encompassed by the base portion, and the base portion has a cut whose location on the base portion corresponds to the feed pin, so that the feed pin can extend below the base portion without contacting the base portion.

19. The wireless network device as claimed in claim 15, wherein a connecting pin is formed at least at a location adjacent to where the base portion is connected with the ground portion, for electrical connection with the ground zone.

20. The wireless network device as claimed in claim 15, wherein the second radiating section stemming from the end of the first radiating section distal from the ground portion extends initially a distance in a same plane as the first radiating section and perpendicular to the connecting edge, and then extends another distance sinuously towards the ground portion in a shape resembling a continuous square wave, in which a total distance extended by the second radiating section is the second length, and the sinuous extension of the second radiating section is spaced from the first radiating section by a predetermined spacing; wherein the predetermined height is between 7 mm and 10 mm and the first length is between 15 mm and 17 mm while the second length is between 25 mm and 35 mm and the predetermined spacing is between 0.4 mm and 0.7 mm.

* * * * *